United States Patent [19]

Eley

[11] B 3,992,595

[45] Nov. 16, 1976

[54] NON-LOAD TAP-CHANGER SWITCH

[75] Inventor: Edgar R. Eley, Jefferson City, Mo.

[73] Assignee: Westinghouse Electric Corporation, Pittsburgh, Pa.

[22] Filed: Dec. 10, 1974

[21] Appl. No.: 531,425

[44] Published under the second Trial Voluntary Protest Program on February 3, 1976 as document No. B 531,425.

[52] U.S. Cl. ..... 200/11 TC; 200/8 R

[51] Int. Cl.[2] ..... H01H 21/18

[58] Field of Search ..... 200/8 R, 8 A, 11 R, 200/11 B, 11 E, 11 EA, 11 K, 11 TC, 17 R, 17 B, 16 B, 16 E, 153 R, 153 LA, 252, 260, 291, 321, 323, 325; 336/94, 150

[56] References Cited

UNITED STATES PATENTS

| | | | |
|---|---|---|---|
| 1,678,129 | 7/1928 | Tuttle | 200/11 TC UX |
| 1,752,213 | 3/1930 | Treanor | 200/11 TC UX |
| 2,675,435 | 4/1954 | Framhein | 200/153 LA X |
| 2,903,530 | 9/1959 | Wilson, Jr. | 200/11 TC |
| 3,005,882 | 10/1961 | White | 200/11 EA |
| 3,170,048 | 2/1965 | Glatz et al. | 200/8 R UX |
| 3,177,305 | 4/1965 | Lehman | 200/11 B X |
| 3,539,736 | 11/1970 | Naimer | 200/153 LA X |
| 3,636,489 | 1/1972 | Colangelo et al. | 200/11 TC X |

*Primary Examiner*—James R. Scott
*Attorney, Agent, or Firm*—C. L. McHale

[57] ABSTRACT

Cylindrical tap terminals are attached to a base plate and are positioned symmetrically around an opening in the base plate. A contact carrier is positioned in the base plate opening and is dimensioned for rotation therein. A movable contact blade is disposed in a radial opening in the contact carrier and is dimensioned to connect together two adjacent tap terminals. A shaft with an inclined surface thereon extends into another opening in the contact carrier and is coupled to an operating handle. The handle may be pulled to move the inclined surface and permit movement of the contact blade away from the tap terminals. Rotation of the handle rotates the shaft, the contact carrier, and the contact blade to another position. When in position, a coil spring forces the inclined surface against the contact blade to maintain adequate electrical contact pressure between the blade and the tap terminals.

9 Claims, 3 Drawing Figures

FIG. 1

NON-LOAD TAP-CHANGER SWITCH

BACKGROUND OF THE INVENTION

1. Field of the Invention

This invention relates, in general, to electrical apparatus and, more specifically, to tap-changers for power transformers.

2. Description of the Prior Art

Non-load tap-changers are often used on distribution transformers to permit different voltage ratings of the transformer windings. Various tap-changer arrangements have been used according to the prior art. Depending upon the particular prior art arrangement, each tap-changer has been characterized as having one or more disadvantages over another tap-changer. Electrical and mechanical performance, economy of construction, size, etc. are all factors which determine the overall usefulness of a particular non-load tap-charger.

Particular emphasis has been placed on the simplicity of construction for reasons of economy and reliability. In addition, the expected life of the moving or conducting parts of the tap-changer is very important and of prime concern in the designing of a suitable tap-changer. The ability to provide enough contact pressure without excessive force being required when changing the tap position is also an important objective. Therefore, it is desirable, and it is an object of this invention, to provide an economical non-load tap-changer which has highly desirable mechanical and electrical characteristics.

SUMMARY OF THE INVENTION

There is disclosed herein a new and useful non-load tap-changer which economically provides a reliable device for changing the winding tap position on a transformer winding. The tap-changer consists of a base plate to which a plurality of cylindrical terminals or studs are connected. The terminals extend around an opening in the base plate and are appropriately connected to the tapped winding. A contact carrier is positioned in the opening in the base plate and contains an opening in which a movable contact blade is inserted. The contact carrier also contains another opening into which a shaft is positioned. During normal operation, the movable contact blade connects together two adjacent terminals on the base plate.

The shaft inserted into the contact carrier includes an inclined surface which engages with the movable contact blade. When the shaft is moved in a direction away from the contact carrier, the movable contact blade is free to move inwardly away from the contact terminals. Rotating the shaft rotates the contact carrier and the movable contact blade to the next tap position. Permitting the shaft to extend back into the contact carrier moves the inclined surface against the movable contact blade and forces the contact blade against the tap terminals for proper electrical contact.

The shaft is connected to an external handle by a suitable rod which extends through a sealing bushing and usually through an enclosure which is located around the tapped winding. A compressed coil spring is positioned around the rod and located between the sealing bushing and the shaft to exert a force on the shaft which acts toward the contact carrier. Thus, when the tap-changer is in a fixed tap position, the force provided by the springs maintains the position of the inclined surface and the movable contact engaged therewith. Since a mechanical advantage results in the use of the inclined surface to move the movable contact blade, the force of the spring is multiplied in producing the force pushing the contact blade against the tap terminal. Thus, a relatively large contact force is maintained without significantly increasing the force required to move the shaft with the handle during the tap-changing sequence. In addition, the spring is not located in a position which conducts current; therefore, the spring maintains its force and is not influenced by heating of the spring due to current flowing therethrough.

BRIEF DESCRIPTION OF THE DRAWING

Further advantages and uses of this invention will become apparent when considered in view of the following detailed description and drawing, in which.

DESCRIPTION OF THE PREFERRED EMBODIMENTS

Figure 1:
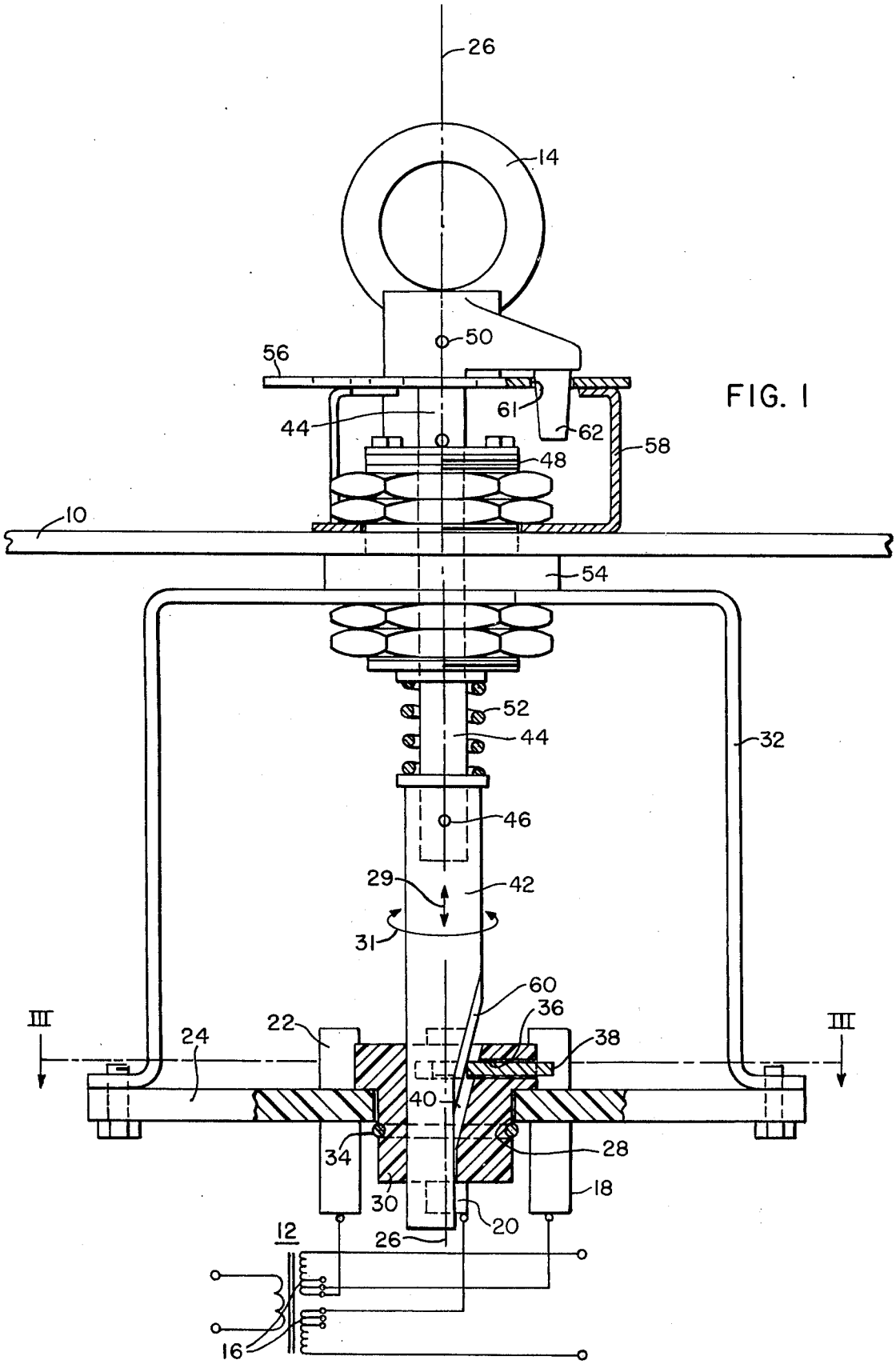
FIG. 1 is a partially, broken-away view of a tap-changer constructed according to this invention.

Throughout the following description, similar reference characters refer to similar elements or members in all of the figures of the drawing.

Referring now to the drawing, and to FIG. 1 in particular, there is shown a cut-away view of a non-load tap-changer constructed according to this invention. In this specific embodiment, the tap-changer is mounted to the tank wall 10 which encloses the core and coil assembly 12 of a distribution transformer. Thus, the handle 14 of the tap-changer is located on the outside of the tank wall 10 and is accessible for moving the contacts of the tap-changer. The tapped transformer winding 16 is illustrated as a split primary or high-voltage winding, however other types of windings and winding configurations may be used with the tap-changer described herein without departing from the invention. In addition, only three of the windings taps are shown connected to the tap terminals for simplicity of the drawing. In actual practice, such a primary winding arrangement would have each of the six winding taps connected to a separate tap terminal on the tap-changer.

The tap-changer includes a plurality of tap terminals or studs of which terminals 18, 20 and 22 are illustrated in FIG. 1. The tap terminals are constructed of cylindrical conductive members which extend through the base plate 24 and are suitably crimped to the leads which extend to the winding taps. The tap terminals are arranged in a symmetrical pattern around the axis 26 which is located at the center of the opening 28 in the base plate 24. The base plate 24 is constructed of a non-conducting material, such as Micarta, and is attached to the bracket 32 which may be constructed of any suitable material, such as steel.

A contact carrier 30, which is constructed of an insulating material, is positioned in the opening 28 of the base plate 24. The contact carrier 30 includes a groove in which the retainer ring 34 is positioned to help prevent longitudinal movement of the contact carrier 30 along the axis 26. The directions of longitudinal movement are indicated by the arrows 29. However, the rotational movement of the contact carrier 30 around the axis 26 is not restricted by the retainer rings 34. The directions of rotational movement are indicated by the arrows 31. The contact carrier 30 includes an opening 36 into which the movable contact or blade 38 is positioned, and an opening 40 into which a portion of the shaft 42 is positioned. Detailed operation and construction of these elements will be described hereinafter.

The shaft 42 is constructed of a suitable insulating material and is attached to the rod 44 by the pin 46. The rod 44 extends through the sealing bushing assembly 48 and is connected to the handle 14 by the pin 50. A compressed coil spring 52 is located around the rod 44 and positioned between the sealing bushing assembly 48 and the shaft 42. The bracket 32 is separated from the tank wall 10 by the spacing ring 54.

A dial plate 56 is attached to the tank wall 10 by the bracket 58. The dial plate 56 contains a plurality of openings, such as the opening 61, through which the extension 62 may project when the tap-changer is set in a proper tap-changing position. The openings in the dial plate 56 are symmetrically aligned around the axis 26 so that an opening is located at each tap position for the projection of the extension 62 through the dial plate 56. This provides a positive lock and position indication that the tap-changer is in the proper location. In making a tap-change, the handle 14 is pulled upwardly, according to the orientation of FIG. 1, and rotated sufficiently until the extension 62 is aligned with the proper opening in the dial plate 56. The handle is then released allowing the handle 14 to move downwardly and the extension 62 to move into the proper opening in the dial plate 56.

Figure 2:
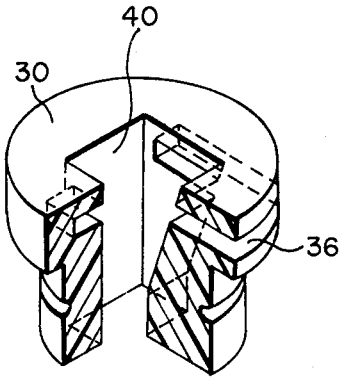
FIG. 2 is a partially, broken-away view of a contact carrier used in a tap-changer constructed according to this invention.

FIG. 2 is a cut-away view of the contact carrier 30 illustrated in FIG. 1. Referring to both FIGS. 1 and 2, the opening 36 extends in a substantially radial direction away from the axis 26 and is dimensioned to guide the blade or movable contact 38 which is constructed of an electrical conducting material, such as copper. The opening 36 extends into the opening 40 of the contact carrier 30. The opening 40 has a non-circular shape for the purpose of transferring rotational movement of the shaft 42 to the contact carrier 30. However, the shaft 42 is free to move longitudinally in and out of the contact carrier 30 without movement of the contact carrier 30.

Figure 3:
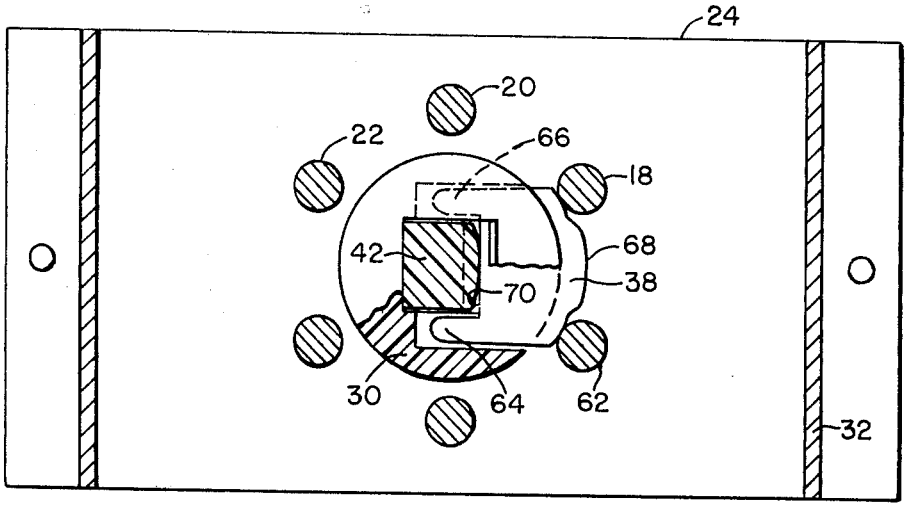
FIG. 3 is a cross-sectional view taken generally along the line III—III of FIG. 1.

FIG. 3 is a cross-sectional view taken generally along the lines III—III shown in FIG. 1. Referring to both FIGS. 1 and 3, it can be seen that the portion of the shaft 42 which extends into the contact carrier 30 is substantially rectangularly shaped. One side of the shaft 42 includes an inclined surface 60 which is positioned to move into contact with the movable contact 38. Thus, when the shaft 42 is pushed downwardly into the contact carrier 30, the inclined surface 60 forces the contact 38 against the tap terminals 18 and 62, thereby providing electrical contact between the tap terminals and between the associated taps on the transformer winding. The contact 38 includes the extensions 64 and 66 which project around the shaft 42 to help maintain alignment of the contact 38 with respect to the shaft 42. The contact 38 also includes a center portion 68 which has a larger radius than the radii of the outer portions of the contact 38 which contact the terminals 18 and 62. The purpose of the enlarged contact portion 68 is to help secure the position of the tap-changer and the movable contact 38 between two adjacent terminals and to prevent rotational movement of the contact 38 when the tap-changer handle is locked in position.

A tap-change is performed by pulling the handle 14, and consequently the shaft 42, upwardly and further compressing the spring 52. The inclined surface 60 moves away from the back portion 70 of the movable contact 38. When the handle 14 and the shaft 42 is rotated to the next tap position, the contact 38 is moved inwardly toward the axis 26 without restriction by the shaft 42 or by the inclined surface 60. When the handle 14 has been rotated to the correct position, the shaft 42 is permitted to move longitudinally downwardly into the contact carrier 30 and the inclined surface 60 forces the contact 38 between the two adjacent terminals. Thus, a different pair of winding taps on the transformer 12 are connected together. Normally, the winding taps of the transformer 12 are connected to the terminals on the tap-changer in such a manner that adjacent terminals on the tap-changer are connected to a different section of the split primary winding. The spring 52 maintains a downward pressure upon the shaft 42 and ultimately exerts a force, through the inclined surface, against the movable contact 38, thus maintaining a substantial force between the contact 38 and the tap terminals on the base plate 24.

The novel arrangement of components described herein permit several important and unique features in the tap-changer which are highly desirable. Since the spring 52 does not come into electrical contact with the movable contact 38, negligible current flows through the spring 52. This assures that substantial heating of the spring 52 will not occur and that the tension in the spring 52 will not be relieved by an annealing process produced by excessive heat generation in the spring 52. Therefore, the amount of force provided upon the contact 38 will remain relatively constant throughout the life of the tap-changer. In addition, there is a mechanical advantage produced by the inclined surface which increases the force of the spring 52 which acts upon the movable contact 38. Consequently, a highly desirable large force between the contact 38 and the tap terminals is created. However, this large force is completely relaxed during a tap-changing sequence, thus mechanical wearing of the tap terminals and of the contact 38 when moving from one position to another tap-changing position is negligible. A further advantage of the unique arrangement of components taught by this invention is the fact that the mechanical advantage provided by this arrangement does not require the operator who is making the tap-change to overcome the entire force which pushes the contact 38 against the tap terminals. In other words, the force required to pull the handle 14 upwardly is not as great as the force which pushes the contact 38 against the tap terminals.

Since numerous changes may be made in the above described apparatus, and since different embodiments of the invention may be made without departing from the spirit thereof, it is intended that all of the matter contained in the foregoing description, or shown in the accompanying drawing, shall be interpreted as illustrative rather than limiting.

I claim as may invention:

1. A non-load tap-changer for tapped electrical windings, comprising:

a plurality of terminals;

means for supporting said terminals in an arc around a first axis;

a contact carrier located between said terminals and being rotatable around said first axis, said contact carrier having first and second openings therein which conjointly communicate with each other;

means for preventing movement of the contact carrier in a longitudinal direction along said axis;

a movable contact positioned in the first opening of the contact carrier and being dimensioned to contact two adjacent terminals;

a shaft extending into the second opening in the contact carrier, said shaft having an inclined surface thereon which is engageable with the movable contact;

means for permitting manual longitudinal movement of the shaft along said axis and manual rotational movement around said axis; and resilient means for forcing the shaft and the inclined surface thereon in a longitudinal direction, with the inclined surface being in contact with and exerting an outward radial force on the movable contact when the movable contact is engaged with the two adjacent terminals.

2. The non-load tap-changer of claim 1 wherein the terminals have a cylindrical shape and the means for supporting the terminals includes a base plate, with the longitudinal axes of the cylindrical terminals being surbstantially parallel to said first axis of the tap-changer.

3. The non-load tap-changer of claim 2 wherein the contact carrier extends through an opening in the base plate, with the center of said opening being coincident with said first axis.

4. The non-load tap-changer of claim 1 wherein the movable contact comprises a blade of conducting material having an arc-shaped outer surface which has sufficient dimensions to contact two adjacent terminals.

5. The non-load tap-changer of claim 1 wherein at least a portion of the shaft and the second opening in the contact carrier have non-circular shapes to allow rotational motion of the shaft to rotate the contact carrier.

6. The non-load tap-changer of claim 1 wherein the inclined surface on the shaft moves radially away from the movable contact when the shaft is moved longitudinally away from the contact carrier.

7. The non-load tap-changer of claim 1 wherein the means for permitting manual longitudinal and rotational movement of the shaft includes a rod attached to the shaft, said rod being connected to a handle which is accessible for manually moving the shaft.

8. The non-load tap-changer of claim 7 wherein the resilient means comprises a compressed coil spring disposed around said rod.

9. A non-load tap-changer for tapped transformer windings, comprising:

a base plate and bracket assembly, said base plate having a circular opening aligned with a first axis;

a plurality of longitudinal tap terminals attached to the base plate and extending around said opening with the axes of said terminals being parallel to said first axis;

a contact carrier extending through the opening in the base plate, said contact carrier having a first non-circular opening therein which is directed generally along said first axis, and a second opening therein which is directed generally in a radical direction perpendicular to said first axis, said first and second openings conjointly communicating with each other;

means for preventing movement of the contact carrier in a longitudinal direction along said first axis;

a movable contact blade slidably positioned in the second opening of the contact carrier, said blade having a sufficient width to contact two adjacent tap terminals;

a non-circular shaft extending into the first opening in the contact carrier, said shaft including an inclined surface which radially moves away from the contact blade when the shaft longitudinally moves out of the first opening;

a rod attached to the shaft and extending through a sealing bushing;

a compressed coil spring disposed around the rod and positioned between the sealing bushing and the shaft; and a handle attached to the rod for moving the rod longitudinally along and rotationally around the first axis, said movable contact being engaged with the inclined surface when the movable contact is engaged with the two adjacent tap terminals.

* * * * *